United States Patent [19]

Ueda

[11] Patent Number: 4,484,065

[45] Date of Patent: Nov. 20, 1984

[54] AUTOMATIC HEATING APPARATUS WITH SENSOR

[75] Inventor: Shigeki Ueda, Yamatokoriyama, Japan

[73] Assignee: Matsushita Electric Industrial Co., Ltd., Osaka, Japan

[21] Appl. No.: 422,195

[22] Filed: Sep. 23, 1982

[30] Foreign Application Priority Data

Oct. 30, 1981 [JP] Japan ..... 56-175493

[51] Int. Cl.[3] ..... H05B 1/02; H05B 6/68

[52] U.S. Cl. ..... 219/492; 219/10.55 B; 219/506; 219/10.55 E; 99/327

[58] Field of Search ..... 219/10.55 B, 10.55 R, 219/10.55 M, 10.55 E, 492, 497, 506; 99/325, 327, 468, 486, 451, DIG. 14; 426/243, 234

[56] References Cited

U.S. PATENT DOCUMENTS 4,097,707 6/1978 Kobayashi et al. ..... 219/10.55 B
4,316,068 2/1982 Tanabe ..... 219/10.55 R X
4,379,964 4/1983 Kanazawa et al. ..... 219/492

FOREIGN PATENT DOCUMENTS 51-134951 11/1976 Japan ..... 219/10.55 B

*Primary Examiner*—P. H. Leung
*Attorney, Agent, or Firm*—Spencer & Frank

[57] ABSTRACT

An automatic heating apparatus comprising a sensor such as a humidity sensor or a gas sensor which senses water vapor, alcohol, $CO_2$ gas or the like emitted from a foodstuff being heated for automatically completing cooking. A microcomputer, which is a controller, monitors variations in the quantity of emitted water vapor, $CO_2$ gas, alcohol or the like with respect to time and, on the basis of the result of this monitoring, decides automatically whether the foodstuff is covered or not with a plastic sheet or is enclosed or not in a lidded container. According to the result of this decision, the heating data including the heating duration and heating output are modified so as to attain optimum heating regardless of the presence or absence of the cover or regardless of the volume of the lidded container.

7 Claims, 16 Drawing Figures

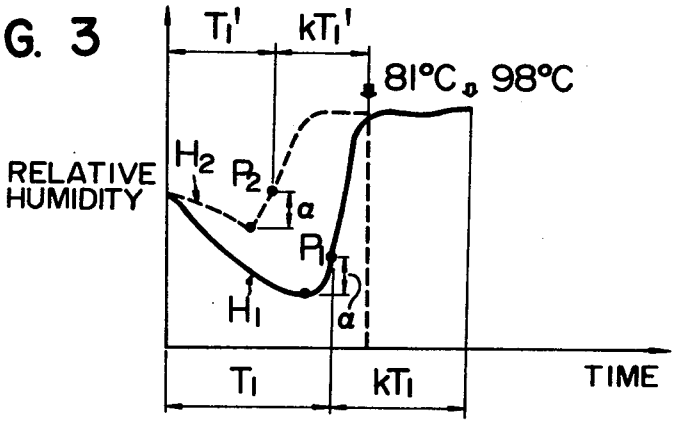
FIG. 3
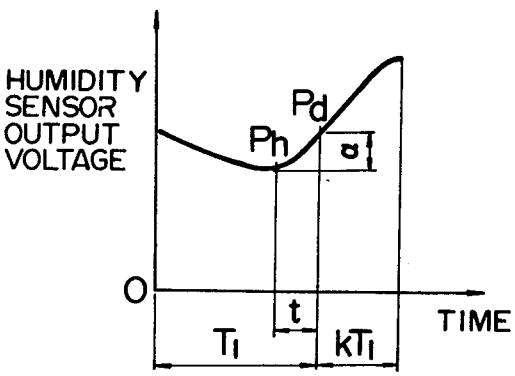
FIG. 4A
FIG. 4B
FIG. 4C
FIG. 4D

AUTOMATIC HEATING APPARATUS WITH SENSOR

BACKGROUND OF THE INVENTION

Semiconductor technology has made such a remarkable progress up to now that miniaturized electronic control circuits operable with an improved functional characteristic and having increased integration density can be mass-produced at low cost, and such electronic control circuits have come to be widely used in both domestic electrical appliances and industrial applications.

In various heating apparatus including electric ovens, microwave ovens, gas ovens and hybrids of these ovens, there has been rapid progress in the development of intelligent electronic control circuits. An especially marked tendency in heating apparatus of the kind above described has been the use of various sensors for sensing the condition of an object being heated thereby automatically controlling the process of heating, and such automatic heating apparatus have very quickly penetrated the market.

Such automatic heating apparatus has gained popularity because the control part responsing to the output of the sensor acts to automatically end the heating sequence in contrast to earlier types in which the user had to manually set the factors including the duration of heating, heating output and heating temperature. Therefore, in a heating apparatus such as a microwave oven in which the factors including the quantity of an object to be heated and the initial temperature must be taken into consideration for cooking, it has become possible to very conveniently handle the oven and to attain desired heating with the least possibility of failure.

An example of such a prior art apparatus is disclosed in Japanese Patent Lay-Open publication No. 51-134951 (1976). In the automatic heating apparatus disclosed in the cited patent application, a so-called humidity sensor senses continuously variations of the relative humidity in the heating cavity resulting from progressive emission of water vapor from an object being heated, until finally a vapor sensing point is reached at which the relative humidity attains a predetermined setting. According to the disclosure, the heating period of time $T_1$ elapsed until the vapor sensing point is reached is added to the product $kT_1$ obtained by multiplying $T_1$ by a separately determined coefficient k peculiar to the object to be heated. These values are used to calculate the sum $(T_1+kT_1)$ which is determined to be the total duration of heating required for satisfactorily cooking the object.

Although the above description refers merely to the control of automatic heating by the use of the so-called humidity sensor, this control method is also very effectively applicable to the control of automatic heating by the use of a so-called gas sensor which reacts with water vapor, alcohol and $CO_2$ gas. However, the disclosed control method has been disadvantageous in that the process of heating is ended before the temperature of an object to be heated has increased sufficiently. That is, the so-called "premature ending of heating" tends to occur, unless the object is made gastight by covering it with a sheet such as a plastic sheet or enclosing it in a lidded container.

FIG. 3 is a graphic representation of such a situation. More precisely, FIG. 3 shows variations, relative to time, of the relative humidity in the heating cavity. It will be seen in FIG. 3 that the relative humidity in the heating cavity decreases gradually immediately after starting of the process of heating due to a gradual rise of the internal temperature of the heating cavity, and, then, when water vapor starts to emit from an object being heated, the relative humidity in the heating cavity shows a sharp increase. In the example, shown in FIG. 3, the object to be heated is water, and the source of heating energy is a magnetron. The solid curve $H_1$ in FIG. 3 represents the case in which a container filled with water is covered with a plastic sheet, and the dotted curve $H_2$ represents the case in which the container is not covered with such a sheet. The temperature of water at the end of the process of heating is shown at the right-hand shoulder portion of each of the curves $H_1$ and $H_2$. The initial temperature of the water was 20° C. in each of these cases. Comparison between the curves $H_1$ and $H_2$ makes it clear that the temperature of the water at the end of the process of heating is lower in the case of the curve $H_2$ than in the case of the curve $H_1$.

It will be seen in FIG. 3 that, in the case of the curve $H_2$ which represents the relative humidity when the object is heated without the cover, the value sensed by the sensor attains a predetermined setting at a point $P_2$ at which partial vaporization starts, resulting in the "premature ending of heating". In contrast, in the case of the curve $H_1$ which represents the relative humidity when the object is heated in the covered state, water vapor and gas are not emitted into the heating cavity from the object until the vapor pressure in the covered container builds up to a certain level. Consequently, the emission of water vapor and gas from the object is sensed at a point $P_1$ which is much later in time than the point $P_2$ and the object can be heated up to a sufficiently high temperature.

It has thus been difficult to effect failure-free heating unless the presence or absence of a cover is specified. By the way, in the case of, for example, reheating of a cooked foodstuff, there is a strong user demand for reheating the cooked foodstuff either in a covered condition or in a non-covered condition depending on the kind of cooked foodstuff to be reheated. In the case of the reheating above described, a better result can be expected when a cooked foodstuff such as fried chicken or rice is reheated without the use of a cover or a lidded container than when it is reheated in a covered or lidded condition. This is because a crisp finish is desired for such a cooked foodstuff. When, on the other hand, a cooked foodstuff such as a boiled or steamed foodstuff is reheated without the use of a cover or a lidded container, it will be excessively dried, resulting in failure of satisfactory reheating.

The same applies also to the cooking of a raw foodstuff. Generally describing, it is important to cook it without a cover when a crisp finish is desired and to cook it with a cover when a wet finish is desired.

The above problem can naturally be solved by arranging more keys on the keyboard of the automatic heating apparatus. However, the user will feel that the selection of a desired key is troublesome when many keys including such additional keys are arranged on the keyboard. That is, the user must select either "REHEATING (WITH COVER)" or "REHEATING (WITHOUT COVER)". The number of required keys is two times as many as that required hitherto, and an input circuit of complex structure is naturally required resulting in an increase in the cost.

Keys specifying the presence and absence of a cover may be provided and manipulated to select a required heating sequence after selection of a menu. However, the number of times such keys have to be manipulated will increase, and the possibility of manipulation will inevitably become high. Anyway, the method of changing over the heating sequences by manipulation of such keys cannot remedy the case in which an object to be heated is loosely covered, giving rise to "premature ending of heating" or the case in which, in spite of the use of a lid covering a container, the result of cooking tends to differ depending on the size of the lidded container.

SUMMARY OF THE INVENTION

In view of such a background, it is an object of the present invention to provide a novel and improved automatic heating apparatus in which the presence or absence of a cover can be automatically sensed by a sensor, so that a heating sequence most suitable for each of a variety of menus can be selected without increasing the number of input keys. The presence or absence of the cover is sensed by continuously monitoring time-related variations of the level of the output signal from the sensor.

Another object of the present invention is to provide an automatic heating apparatus which informs or announces the result of a decision regarding the presence or absence of the cover. The automatic heating apparatus is so constructed that, when the result of a decision is not correct, the error can be corrected from an external correcting unit.

BRIEF DESCRIPTION OF THE DRAWINGS

The present invention will be apparent from the following detailed description taken in conjunction with the accompanying drawings, in which:

FIG. 3 is a graph showing the results of automatic heating of water, in which the curve $H_1$ represents the result when water contained in a container is covered, and the curve $H_2$ represents the result when the water is not covered;

FIGS. 4A to 4D are graphs showing various time-related variations of the level of the output signal from a humidity sensor when the humidity sensor is used for automatic heating;

DESCRIPTION OF THE PREFERRED EMBODIMENTS

Figure 1:
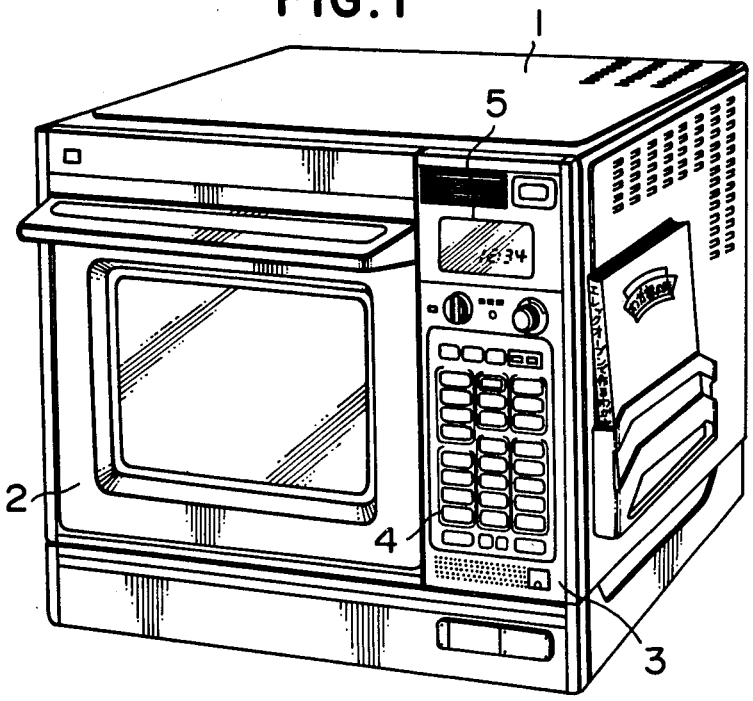
FIG. 1 is a general external perspective view of a preferred embodiment of the automatic heating apparatus according to the present invention.

Referring to FIG. 1 which is a general external perspective view of a preferred embodiment of the automatic heating apparatus according to the present invention, a door 2 is openably mounted on the front wall of a case 1 to normally close an opening in the front wall of the case 1, and a control panel 3 is disposed on another portion of the front wall of the case 1. The control panel 3 includes at least a keyboard for selecting a heating sequence corresponding to an object to be heated, and a display part 5 for displaying and informing or announcing various information.

Figure 2:
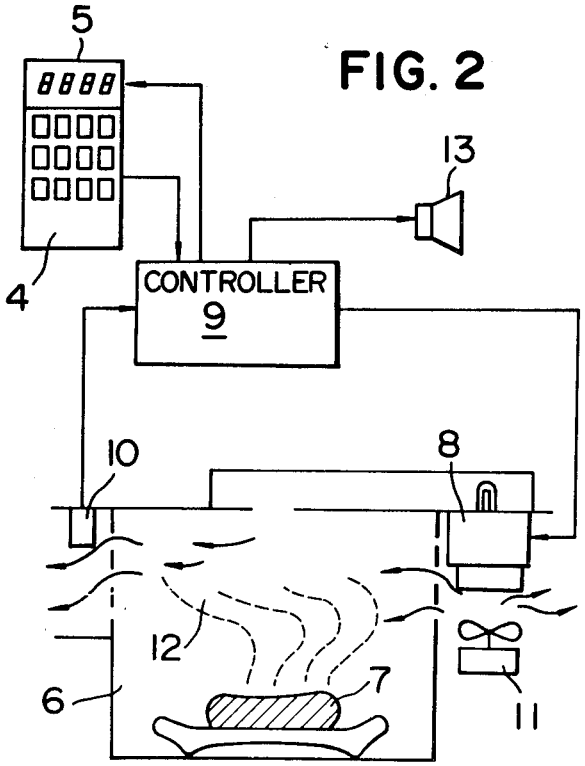
FIG. 2 is a block diagram showing generally the structure of the automatic heating apparatus shown in FIG. 1.

FIG. 2 is a block diagram showing generally the structure of the automatic heating apparatus shown in FIG. 1. Referring to FIG. 2, an object 7 to be heated is placed in a heating cavity 6 which is coupled to a magnetron 8 acting as a source of heating energy. Supply of power to the magnetron 8 is controlled by a control part 9. The detailed structure of this control part 9 will be described later. Gases 12 including water vapor, alcohol and $CO_2$ gas emitted or liberated from the object 7 while the object 7 is being heated are exhausted to the exterior of the heating cavity 6 by a fan 11 to be sensed by a sensor 10 which is a humidity sensor, a gas sensor or the like. On the basis of the sensed data output signal from the sensor 10, the control part 9 controls the supply of power to the magnetron 8 and supplies various data to the display part 5 to be displayed on the display part 5. At the same time, the control part 9 applies a synthesized voice signal or a buzzer energization signal to a speaker or a buzzer 13 for announcing various message intelligences by means of the synthesized voice or alarm sound.

How the control part 9 shown in FIG. 2 operates will now be described. The graph shown in FIG. 3 has already been described in detail. In short, the graph shown in FIG. 3 teaches that different heating sequences must be selected depending on whether an object to be heated is covered or not, even when the object is the same. According to the present invention, the most suitable heating sequence is not selected in response to the input from the corresponding key, but is selected on the basis of the result of monitoring of time-related variations of the level of the output signal from the sensor.

FIGS. 4A to 4D are graphs showing how the level of the output signal from a humidity sensor varies relative to time during the process of actual cooking. The humidity sensor used for providing the graphs shown in FIGS. 4A to 4D is incorporated in a circuit (which will be described later with reference to FIG. 7) so as to sense variations of the relative humidity in the heating cavity. FIG. 4A represents the case in which an object to be heated is covered, while FIG. 4B represents the case in which the object is not covered although the heating sequence is the same. The occurrence of "premature ending of heating" in the case of FIG. 4B has been described already with reference to FIG. 3. FIGS. 4C and 4D corresponding to FIG. 4B are graphs showing the manner of automatic heating according to the present invention.

At a point Ph on the curve in each of FIGS. 4A and 4B, emission of water vapor from the object being heated is sensed, and, at a point Pd at which the increment of the quantity of emitted vapor exceeds a predetermined setting $\alpha$, emission of vapor beyond the setting $\alpha$ is decided. At this point Pd, the presence or absence of the cover is discriminated by a method which will be described presently. The setting $\alpha$ may represent an absolute variation or a relative variation. The latter is given by the ratio between the voltage level at the point Ph and that at the point Pd.

After the heating sequence is started, the internal temperature of the heating cavity rises gradually, while, on the other hand, a very small quantity of water vapor is emitted from the object being heated. Consequently, the relative humidity in the heating cavity decreases, in general, from time 0 to a time corresponding to the point Ph. Then, from this time or point Ph, the quantity of vapor emitted from the object being heated increases sharply, and the relative humidity in the heating cavity starts to increase in a relation contrary to the previously decreasing tendency. At the point Pd at which the increment of the quantity of emitted vapor attains the predetermined setting $\alpha$, the control part 9 decides that the relative humidity has attained its setting and commands that the heating sequence should shift to the control of an additional heating period of time. However, depending on whether the object being heated is covered or not, the period of time t from the point Ph to the point Pd relative to the period of time $T_1$ from time 0 to the time corresponding to the point Pd differs considerably. That is, when the object being heated is covered, this period of time t relative to the period of time $T_1$ is short to indicate that the quantity of emitted vapor increases sharply, while, when the object is not covered, the quantity of emitted vapor increases relatively gently, and the period of time t relative to the period of time $T_1$ is longer than the former case. Of course, the absolute values of $T_1$ and t are not the decisive factors, because they become long or short depending on the quantity of the object to be heated. However, when the ratio $t/T_1$ therebetween is compared with a threshold value, it is possible to discriminate between the presence and the absence of a cover. According to the results of experiments in which a plurality of menus were cooked to find the ratio $t/T_1$, it was given by $$t/T_1=0.04\sim0.3$$

when a cover was provided, and given by $$t/T_1=0.46\sim1.0$$

when such a cover was not provided. Thus, the presence or absence of a cover could be reliably discriminated when the threshold value was selected to be about 0.38. It is unnecessary to mention that the presence or absence of a cover will be more reliably discriminated by changing this threshold value depending on the selected menu, that is, depending on the selected key to be manipulated.

Besides the ratio $t/T_1$, the ratio $t/(T_1-t)$ or the ratio $(T_1-t)/T_1$ may, for example, be considered. Further, although the point Ph is illustrated to indicate the time at which the humdity sensor starts to sense water vapor emitted from an object being heated in the embodiment of the present invention, it is naturally possible to arrange that the point Ph indicates the time at which, for example, the increment of the quantity of emitted vapor attains the value of $\alpha/2$.

After, for example, the absence of the cover has been decided, the constant k which is the coefficient determining the additional heating period of time kT shown in the graph of FIG. 4B is modified to be k' which is larger than the value of the constant k as shown in the graph of FIG. 4C showing the heating sequence according to the present invention. By providing the longer additional heating period of time k'T, the total heating duration is increased to prevent "premature ending of heating". Alternately, in the case of FIG. 4D corresponding also to FIG. 4B in which the absence of the cover is found at the point Pd, the setting $\alpha$ is modified to be $\alpha'$ which is larger than $\alpha$, and the counting of the period of time $T_1$ is continued until the new setting $\alpha'$ is reached at a new sensing point Pd'. Then, on the basis of a period of time $T_1'$ required until the point Pd' is reached, the additional heating period of time $kT_1'$ is calculated to extend the total heating duration thereby preventing "premature ending of heating".

Figure 5A:
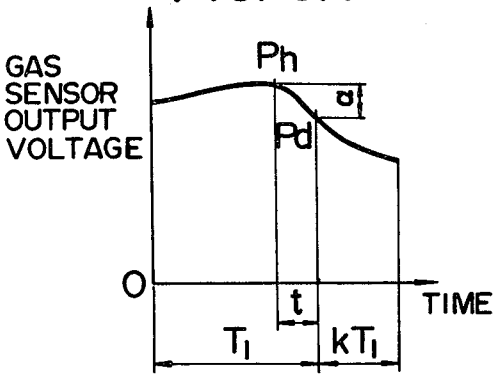
FIGS. 5A to 5D are graphs showing the procedure for sensing the presence or absence of a cover when a gas sensor is used.
Figure 5B:
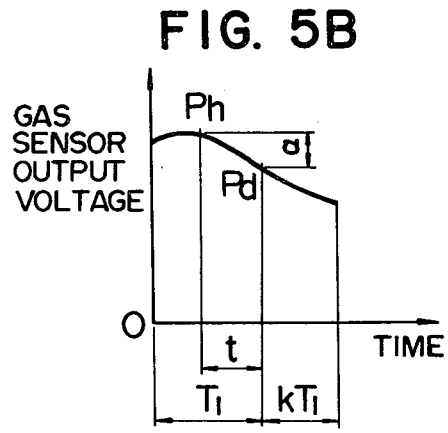
Figure 5C:
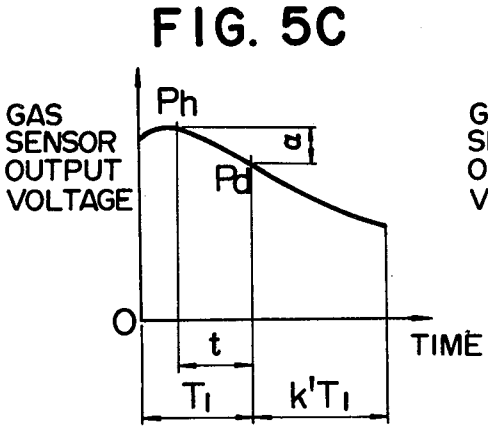
Figure 5D:
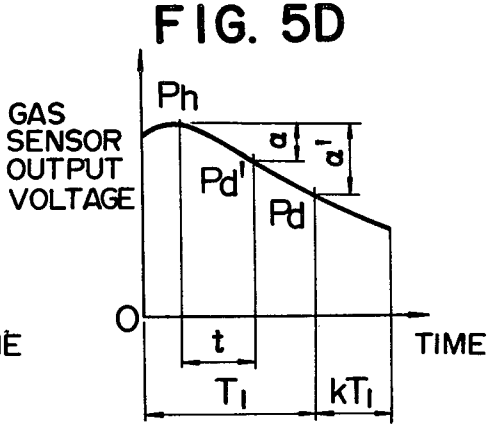

FIGS. 5A, 5B, 5C and 5D are graphs obtained when a gas sensor is employed. This gas sensor is incorporated in a circuit (which will be described later with reference to FIG. 8) so that a variation of the impedance across the sensor can be directly read. FIG. 5A represents the case in which an object to be heated is covered as in the case of FIG. 4A, while FIG. 5B represents the case in which the object is not covered although the heating sequence is the same, as in the case of FIG. 4B. FIGS. 5C and 5D corresponding to FIG. 5B are graphs showing the manner of automatic heating according to the present invention in which the constant k or the setting o is similarly modified when the absence of a cover is decided. It will be apparent from FIGS. 5C and 5D that the present invention is equally effectively applicable to an automatic heating apparatus employing a gas sensor for the control of automatic heating.

Figure 6:
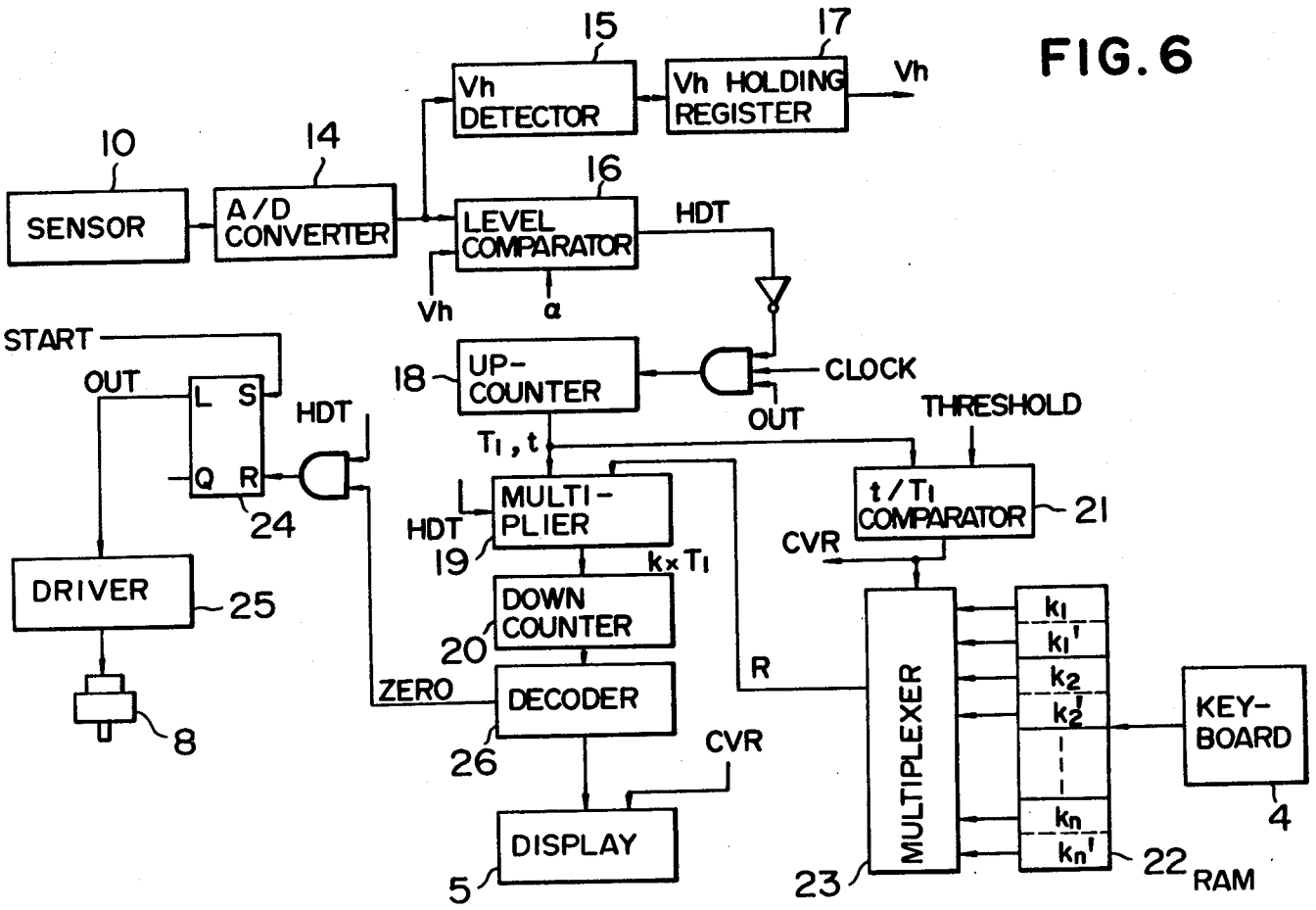
FIG. 6 is a functional block diagram of the control part of the automatic heating apparatus of the present invention.

The above manner of monitoring makes it possible to discriminate whether an object to be heated is covered or not. The practical structure of the control part 9 for realizing the desired automatic heating control will now be described in detail. FIG. 6 is a block diagram showing the functional structure of this control part 9. Referring to FIG. 6, a sensor 10 senses an analog quantity, and its output signal indicative of the sensed analog quantity is applied to an A/D converter 14 to be converted into the corresponding digital quantity. The A/D converter 14 applies its output signal indicative of the digital quantity to a Vh detector 15 and to a level comparator 16. The Vh detector 15 detects the voltage level Vh at the point Ph. When the sensor 10 is a humidity sensor, the Vh detector 15 detects the lowest voltage level (as described later with reference to FIG. 7), while when the sensor 10 is a gas sensor, the Vh detector 15 detects the highest voltage level (as described later with reference to FIG. 8). The output signal from the Vh detector 15 is applied to a Vh holding register 17 to be stored therein. In the practical operation, the Vh detector 15 reads out first the Vh date stored in the Vh holding register 17 and compares the stored Vh data thus read out with a new Vh data to renew the Vh data to be stored in the Vh holding register 17.

In the meantime, the level comparator 16 compares the Vh data with the sensor information applied from the A/D converter 14 to decide whether or not the predetermined variation setting $\alpha$ is exceeded, that is, to detect the point Pd. When the result of comparison in the level comparator 16 proves that the point Pd is reached, the level comparator 16 applies its output signal HDT to an AND gate through an inverter.

In response to the signal HDT applied through the AND gate, an up-counter 18 ceases to count clock pulses. The signal indicative of the period of time $T_1$ counted by the up-counter 18 is applied to a multiplier 19 in which the period of time $T_1$ is multiplied by the constant k to calculate the additional heating period of time $kT_1$, and this $kT_1$ is pre-set in a down-counter 20. Prior to the above step, a $t/T_1$ comparator 21 compares the ratio $t/T_1$ with a predetermined threshold value to discriminate as to whether an object being heated is covered or not, and its output signal CVR is applied to a multiplexer 23. A random access memory (RAM) 22 stores therein a plurality of values $k_1$, $k_1'$, $k_2$, $k_2'$,---, $k_m$, $k_m'$,---, $k_n$, $k_n'$ of the constant k corresponding to a plurality of menus to be selected by the keys arranged on the keyboard 4 respectively. In response to the application of the signal CVR to the multiplexer 23, the value $k_m$ or $k_m'$ of the constant k corresponding to the selected menu is selected depending on whether the object being heated is covered or not, and the output signal R indicative of the selected value of the constant k is applied from the multiplexer 23 to the multipler 19 which calculates the additional heating period of time $kT_1$.

The output signal CVR from the $t/T_1$ comparator 21 is also applied to the display part 5 so that, when, for example, the result of comparison or decision in the $t/T_1$ comparator 21 proves that the object being heated is covered, the status "COVER" is displayed on the display part 5. An arrangement may be provided so that, when the result of decision by the $t/T_1$ comparator 21 is not correct, the user can manipulate the keyboard 4 to correct the erroneous display. Further, a voice synthesizer circuit may be provided in the control system so as to announce the result of decision by a synthesized voice. The provision of such a synthesizer circuit is preferable in that the user can hear the announced result of decision even at a place remote from the heating apparatus.

In the meantime, a flip-flop 24 is set in response to the depression of the start key, and its output signal OUT is applied to a driver circuit 25 to start energization of the magnetron 8. After the heating sequence has shifted to the additional heating mode and a decoder 26 detects that the count of the down-counter 20 has become zero, that is, after the additional heating period of time $kT_1$ has elaspsed, the flip-flop 24 is reset by the output signal ZERO from the decoder 26 to stop heating by the magnetron 8.

It will be seen from the above description that, by the function of the control part 9 whose detailed structure is shown in FIG. 6, whether an object being heated is covered or not can be discriminated, and the heating sequence most suitable for the heating of the object can be automatically selected. Although the embodiment described above is based on the method of selection of a suitable value of the constant k depending on the result of decision by the $t/T_1$ comparator 21 and also depending on the selected menu, another method may be employed in which, after the decision by the $t/T_1$ comparator 21, a suitable value of the setting $\alpha$ is selected and the counting by the up counter 18 is further continued. Such a method can be easily realized in the block diagram shown in FIG. 6. Further, the functional blocks shown in FIG. 6 may be replaced by programmed software logic, and the greater proportion thereof may be executed by a stored-logic controller such as a microcomputer.

Figure 7:
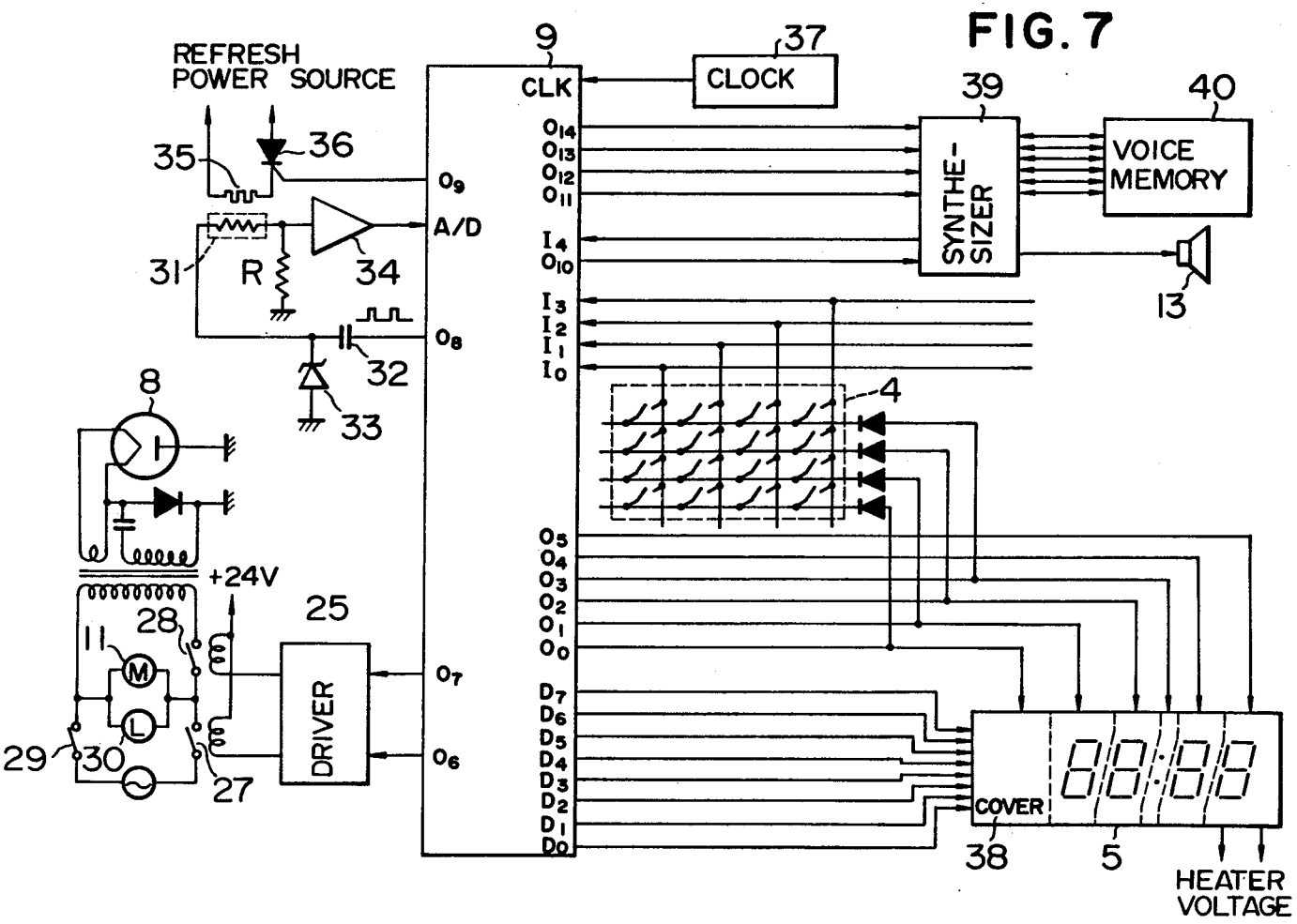
FIG. 7 is a circuit diagram showing the practical structure of one form of the circuit in which a microcomputer and a humidity sensor are used for the control of automatic heating.

FIG. 7 shows a practical form of the circuit in which a microcomputer is used as the controller, and a humidity sensor is used as the sensor. In FIG. 7, most of the functional blocks shown in FIG. 6 are replaced by programmed software logic executed by the microcomputer. The practical structure of the circuit will now be described with reference to FIG. 7.

Referring to FIG. 7, the main control unit or microcomputer 9 receives an operation command signal applied from the keyboard 4 in response to manipulation by the user. The keyboard 4 is in the form of a key matrix which is swept by outputs $O_o$ to $O_3$ of the microcomputer 9 and connected to inputs $I_3$ to $I_o$ of the microcomputer 9.

A fluorescent display tube 5 functioning as the display part provides required displays by being dynamically energized. Data to be displayed are transmitted to the display tube 5 from outputs $D_o$ to $D_7$ of the microcomputer 9, and outputs $O_o$ to $O_5$ of the microcomputer 9 control the grids of the display tube 5. That is, the grids of the display tube 5 are sequentially swept from the microcomputer outputs $O_o$ to $O_5$. The microcomputer outputs $O_o$ to $O_3$ used for sweeping the keyboard 4 are also used for controlling the energization of the display tube 5.

When a command signal indicative of a selected menu is applied from the keyboard 4 to the microcomputer 9, the microcomputer 9 decodes this command signal and selects the corresponding heating sequence. A plurality of such heating sequences are programmed in the ROM of the microcomputer 9, and the data including the constants required for the execution of the selected heating sequence are transferred from the ROM to the RAM, so that the heating sequence shown in FIG. 4C or 4D can be executed.

The driver 25 cooperates with a time relay 27 and a power relay 28 to supply required power to the magnetron 8. The time relay 27 is continuously turned on during the period of time in which the power is to be continuously supplied to the magnetron 8, while the power relay 28 is repeatedly turned on and off during the period of the power supply so as to change the mean output of the magnetron 8. The time relay 27 and the power relay 28 are controlled by outputs $O_6$ and $O_7$ of the microcomputer 9 respectively. The main circuit further includes a door switch 29 responsive to the opening and closure of the door 2, a motor group 11 including a fan motor, and an internal lamp 30 of the heating apparatus.

When the heating sequence is started according to the procedure above described, the microcomputer 9 starts to measure the relative humidity in the heating cavity in response to the application of the output signal from the humidity sensor 31. An output $O_8$ of the microcomputer 9 applies a pulse waveform to the humidity sensor 31, and a capacitor 32 removes DC components from this pulse waveform. A Zener diode 33 applies a regulated voltage across the humidity sensor 31 and acts also to protect the humidity sensor 31 against an overvoltage. By the function of this circuit, no Dc voltage is applied to the humidity sensor 31 thereby ensuring a long service life of the humidity sensor 31. The resistance value of the humidity sensor 31 varies greatly with the variation of the relative humidity in the heating cavity. The signal indicative of this resistance variation is suitably amplified by an amplifier 34 before being applied to an A/D input of the microcomputer 9. This input A/D is an input terminal having a build-in A/D converter. A refresh heater 35 is provided so that contaminant matters deposited on the surface of the humidity sensor 31 can be burnt away prior to cooking. Supply of current from a refresh power source to the refresh heater 35 is controlled by an output $O_9$ of the microcomputer 9, and a switching element 36 is connected between the output $O_9$ and the refresh power source for this purpose.

The microcomputer 9 measures the relative humidity in the heating cavity on the basis of the output signal of the humidity sensor 31 applied to the input A/D, and also counts the periods of time $T_1$ and t on the basis of clock pulses applied to an input CLK from a clock circuit 37. On the basis of the counts of the periods of time $T_1$ and t, the microcomputer 9 decides that the object being heated is covered or not in a manner as described already with reference to FIGS. 4A to 4D.

When the result of decision proves that the object being heated is covered, the result of decision is displayed on the "COVER" status 38 which is one of the statuses displayed on the display tube 5. At the same time, a synthesized voice, for example, "COVER" is announced from the speaker 13 connected to a synthesizer 39 connected to a voice memory 40. If such a decision is not correct, the user corrects this decision on the keyboard 4 which includes means for re-setting the heating sequence.

The synthesizer 39 receives address data and mode data from outputs $O_{11}$ to $O_{14}$ of the microcomputer 9, and, while shaking hands with an input $I_4$ and an output $O_{10}$ of the microcomputer 9, converts a voice data read out from the voice memory 40 into the corresponding synthesized voice. Such a synthesizer may include an LSI adapted for synthesis of speech according to the PARCOR method.

Figure 8:
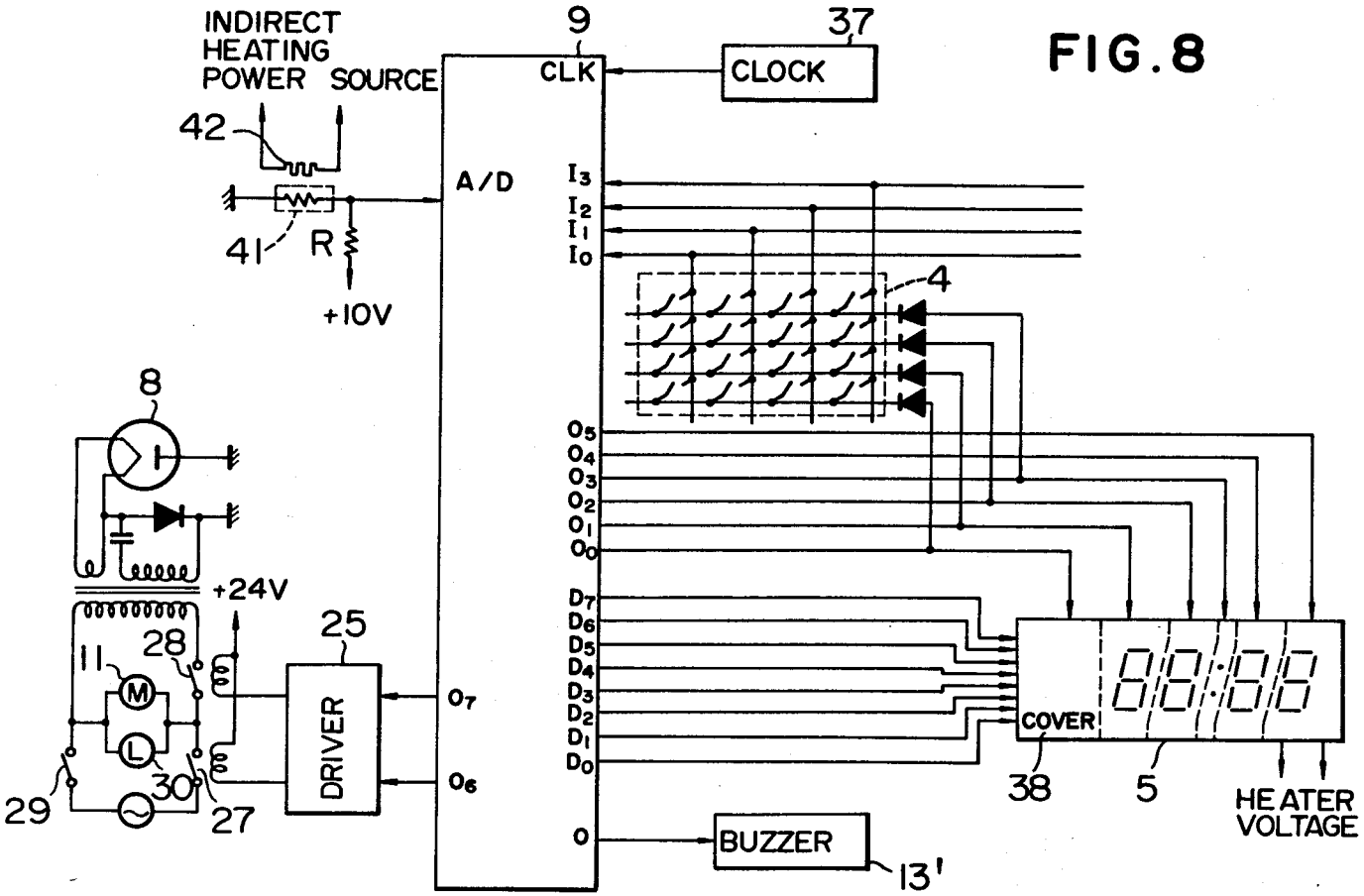
FIG. 8 is a circuit diagram showing the practical structure of another form of the circuit in which a microcomputer and a gas sensor are used for the control of automatic heating.

FIG. 8 shows a circuit which is generally similar to that shown in FIG. 7 but differs from the latter in that a gas sensor 41 is used in place of the humidity sensor 31. The gas sensor 41 reacts with gases such as water vapor, $CO_2$ gas and alcohol in gas form, and its impedance decreases by reaction with such gases. In order that such an impedance variation can be directly read, an input voltage obtained by dividing a power source voltage by the gas sensor 41 and a reference resistor R is applied to the input A/D of the microcomputer 9. A heater 42 of the indirect heating type is associated with the gas sensor 41 so that the temperature of the atmosphere ambient to the gas sensor 41 can increase to the temperature zone in which the gas sensor 41 is satisfactorily sensitive to water vapor and alcohol.

In the circuit shown in FIG. 8, a buzzer circuit 13' is provided in lieu of the combination of the synthesizer 39, voice memory 40 and speaker 13 shown in FIG. 7, so that it generates a buzzer alarm at the time at which the presence or absence of a cover covering an object being heated is decided. At the same time, the "COVER" status 38 is displayed on the display tube 5.

Figure 9:
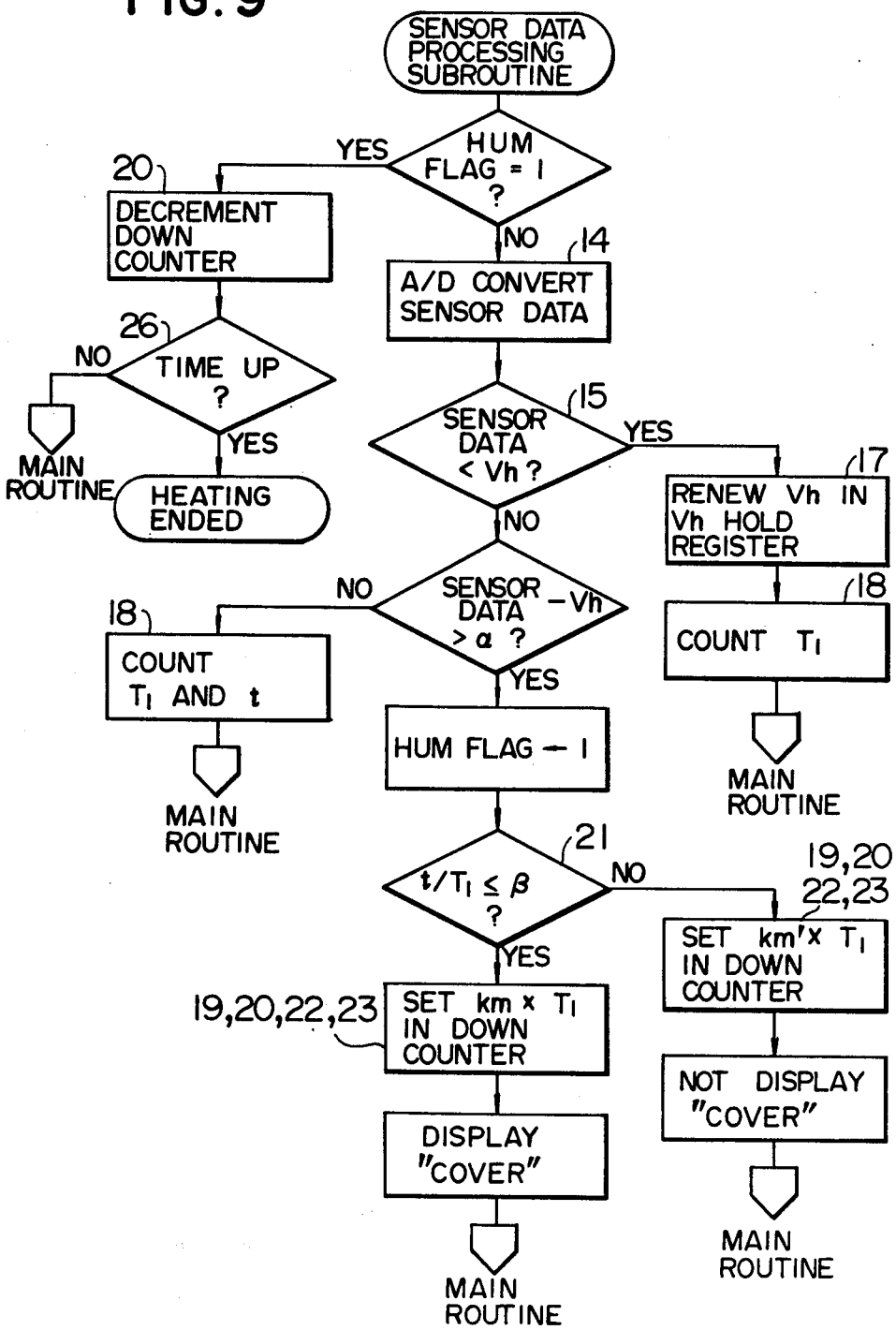
FIG. 9 is a flow chart showing one form of program executed by the microcomputer.

FIG. 9 is a flow chart of part of the program stored in the microcomputer 9. The flow of steps will be described while comparing the steps with the functions of the blocks shown in FIG. 6. In FIG. 9, the steps are designated by the same reference numerals as those of the corresponding functions of the blocks shown in FIG. 6, and thus, it is readily apparent how the blocks shown in FIG. 6 are replaced by software logic.

In the initial step of the sensor data processing subroutine, the status of the HUM FLAG is judged. This flag is set at the time corresponding to the point Pd. That is, in this initial step, judgment is made as to whether the heating sequence is in its humidity sensing mode or in its additional heating ($kT_1$) mode. When the result of judgment in the initial step proves that the shift to the additional heating mode has started, the down-counter is decremented (at step 20). On the other hand, when the result of judgment in the initial step proves that the heating sequence is in its humidity sensing mode, the sensor data is A/D converted (14), and the Vh data now read is compared with the previously stored Vh data (15). That is, renewal of the Vh data is checked (17). When the Vh data newly read is proved to be smaller than the previously stored Vh data, the Vh data registerd already in the Vh holding resister is renewed, and the period of time $T_1$ is counted. Then, the sensor data processing subroutine returns to the main routine.

The renewal or updating of the Vh data registered in the Vh holding register is continued until finally the point Ph is reached and exceeded. When the point Ph is exceeded, the newly-read Vh data is larger than the previously stored Vh data. (In the case of the gas sensor described with reference to FIGS. 5 and 8, the newly-read Vh data becomes smaller than the previously stored Vh data.) Then, a judgment is made as to whether the difference therebetween is equal to or larger than a predetermined threshold value $\alpha$ (16). That is, the point Pd is detected when the above relation holds. Until the point Pd is reached, the periods of time $T_1$ and t are continuously counted (18). When the point Pd is finally reached, the HUM FLAG described in the initial step is set. A bit in the RAM is allotted to this flag and is rewritten depending on the condition of progress of the heating sequence to be utilized for various purposes.

After the HUM FLAG has been set, comparison is made as to whether the ratio $t/T_1$ is larger than a predetermined threshold value $\beta$ (21). (This predetermined threshold value is 0.38 in the example shown in FIGS. 4A to 4D.) When the result of comparison proves that $t/T_1$ is larger than $\beta$, the microcomputer 9 decides that the object being heated is not covered, and the value ($k_m' \times T_1$) is set in the down counter (19, 20, 22, 23). The "COVER" status 38 is not displayed on the display tube 5 in such a case. When, on the other hand, the result of comparison proves that $t/T_1$ is equal to or smaller than $\beta$, the microcomputer 9 decides that the object being heated is covered, and the value ($km \times T_1$) is set in the down counter (19, 20, 22, 23). The "COVER" status 38 is displayed on the display tube 5 in such a case. The values of $k_m$ and $k_m'$ are selected to be $k_m < k_m'$ so as to prevent "premature ending of heating" when the object being heating is not covered.

The portion of the program above described represents the subroutine for sensor data processing, and such a subroutine is executed by jumping or calling from the main routine at, for example, predetermined time intervals. The length of time required for the A/D conversion by the A/D converter built in the microcomputer 9 and forming part of the hardware may be so determined that the A/D conversion is completed during the period of execution of this subroutine. The main routine executes the steps such as display of various data on the display tube 5 and application of key information to the microcomputer 9.

It can thus be understood that most of the functions of the blocks shown in FIG. 6 can be replaced by the programmed software logic.

In the aforementioned embodiment, the voltage data Vh is sequentially compared with a new data to renew the data Vh stored in the Vh holding register 17. However, the data output signal from the sensor 10 may be sequentially sampled at predetermined time intervals to be stored in a memory, and the variation of the stored sampled data relative to time may be suitably retrieved to detect the value of Vh and the values of $T_1$ and t.

Figure 10:
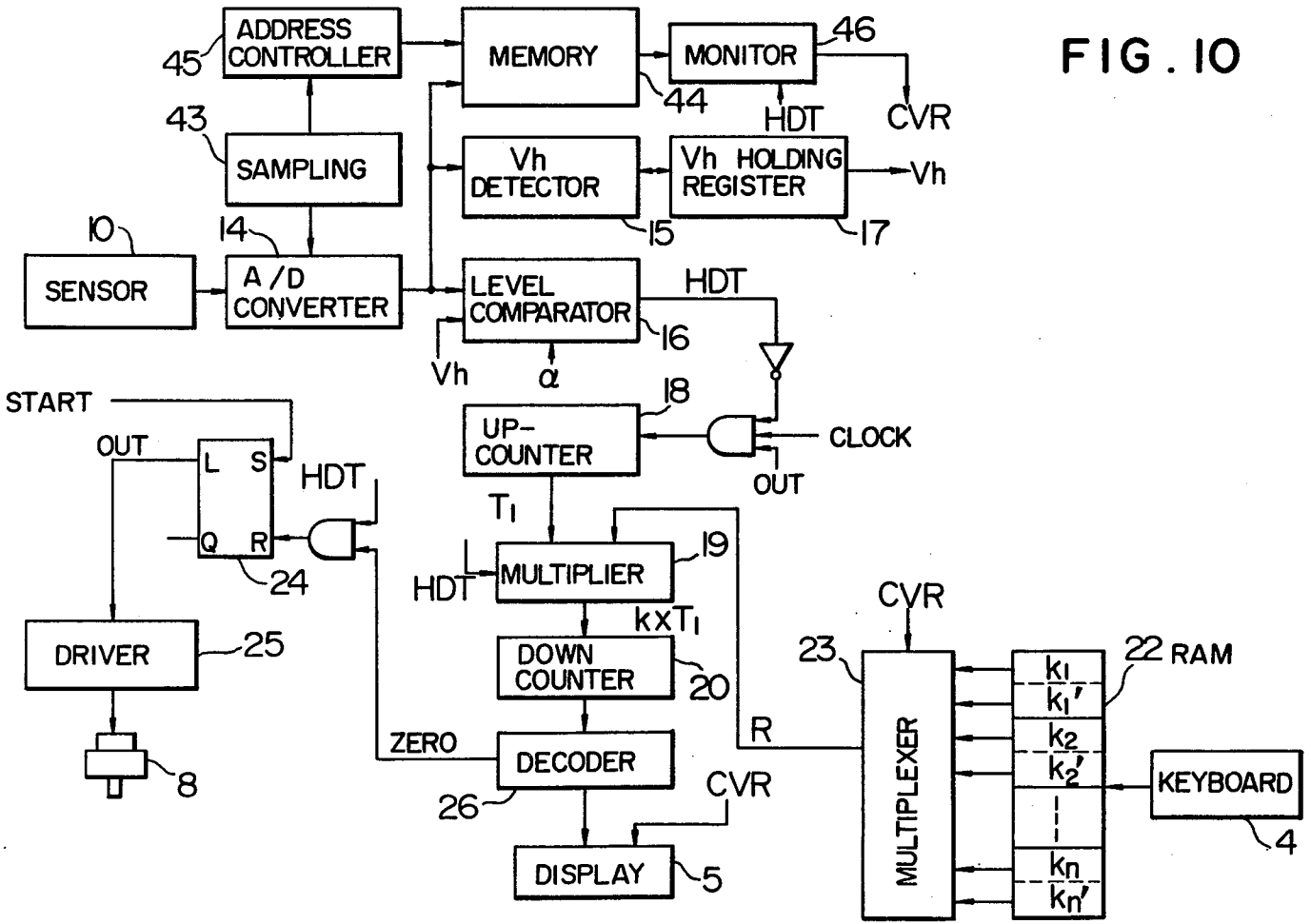
FIG. 10 is a functional block diagram of another form of the control part of the automatic heating apparatus of the present invention.

FIG. 10 is a functional block diagram of this form of the control part 9.

As compared with the FIG. 6, a sampling unit 43, memory 44, address controller 45 and monitor unit 46 are added instead of the $t/T_1$ comparator 21. The data output signals from the sensor 10 supplied to the A/D converter 14 are sequentially sampled at predetermined time intervals by a sampling unit 43, and these sampled data are stored in the memory 44 by the address controller 45. The memory 44 also stores standard data corresponding to each k parameter ($k_1, k_1', \ldots k_n, k_n'$.) which represents each menu on the keyboard 4. The monitor 46 retrieves the sampled data and the standard data from the memory 44 and compares these two data when the predetermined humidity (HDT) is detected thereby determining whether the object to be heated is covered or not.

I claim:

1. An automatic heating apparatus comprising:

a heating cavity in which an object to be heated is placed;

a source of heating energy coupled to said heating cavity;

sensor means whose property is variable as a result of reaction with at least one of water vapor, alcohol and carbon dioxide gas or their mixture emitted from the object being heated, said sensor means generating an output signal; and control means for controlling power supplied to said source of heating energy, said control means including counter means for counting the period of time required for the level of the output signal from said sensor means to attain a predetermined setting, and monitor means for monitoring the sensor output level varying relative to time until said predetermined setting is attained, said control means deciding, on the basis of the result of monitoring by said monitor means, that the object being heated is covered or not with a covering sheet or is enclosed or not in an enclosure, and multiplying the period of time counted by said counter means by a heating time coefficient which differs depending on whether or not the object being heated is covered with the covering sheet or enclosed in the enclosure thereby calculating an additional heating period of time.

2. An automatic heating apparatus comprising:

a heating cavity in which an object to be heated is placed;

a source of heating energy coupled to said heating cavity;

sensor means whose property is variable as a result of reaction with at least one of water vapor, alcohol and carbon dioxide gas or their mixture emitted from the object being heated, said sensor means generating an output signal; and control means for controlling power supplied to said source of heating energy, said control means including counter means for counting the period of time required for the level of the output signal from said sensor means to attain a predetermined setting, and monitor means for monitoring the sensor output level varying relative to time until said predetermined setting is attained, said control means deciding, on the basis of the result of monitoring by said monitor means, that the object being heated is covered or not with a covering sheet or is enclosed or not in an enclosure, and if the object being heated is not covered with the covering sheet or not enclosed in the enclosure, changing tne value of the predetermined setting and counting by said counter means the period of time required for the level of the output signal from said sensor means to attain said changed value of the predetermined setting, and then multiplying the period of time last counted by said counter means by a heating time coefficient.

3. An automatic heating apparatus as claimed in claim 1 or 2, wherein said monitor means detects the time at which the water vapor, alcohol, carbon dioxide gas or their mixture starts to emit from the object being heated, and counts from the detected time the period of time required for the level of the output signal of said sensor means to attain said predetermined setting, and said control means decides, on the basis of the result of monitoring by said monitor means, that the object being heated is covered or not with the covering sheet or is enclosed or not in the enclosure.

4. An automatic heating apparatus as claimed in claim 1, wherein said monitor means includes sampling means for sampling the level of the output signal of said sensor means at predetermined sampling time intervals, and memory means for storing sequentially the sampled output signal level of said sensor means, and said control means retrieves the variation relative to time of the output signal level stored in said memory means to detect that the object being heated is covered or not with the covering sheet or is enclosed or not in the enclosure.

5. An automatic heating apparatus as claimed in claim 4, wherein externally correcting means is provided so that, when the result of decision by said control means is not correct, the error can be corrected by said correcting means.

6. An automatic heating apparatus as claimed in claim 1, wherein, when said control means decides that the object being heated is covered or not with the covering sheet or is enclosed or not in the enclosure, the result of said decision being informed by at least one of announcing means and display means.

7. An automatic heating apparatus as claimed in claim 1, wherein said counter means counts a first period of time (t) from the time at which the water vapor, alcohol and carbon dioxide gas or their mixture starts to be emitted from the object being heated until the level of the output signal from said sensor means attains said predetermined setting, said control means further including comparator means for comparing with a threshold value the ratio of said first period of time (t) to a second period of time ($T_1$) corresponding to the period of time counted by said counter means from the start of heating until the level of the output signal from said sensor means attains said predetermined setting, and said monitor means determines whether or not the object is covered with the cover based on whether said ratio is less than said threshold value or not.

* * * * *